US012013129B2

(12) United States Patent
Koether et al.

(10) Patent No.: US 12,013,129 B2
(45) Date of Patent: Jun. 18, 2024

(54) DRIVE STRUCTURE FOR MOVING AN ARTICULATED CONTROL PANEL ON A COOKING APPLIANCE

(71) Applicant: TECHNOLOGY LICENSING CORPORATION, Fort Lauderdale, FL (US)

(72) Inventors: Ben Koether, Fort Lauderdale, FL (US); Edward Musial, Monroe, CT (US); Mike Keefe, Brookfield, CT (US); Christos Kambouris, Shelton, CT (US); Oswald Mesidor, Waterbury, CT (US); Mark Slavin, Waterbury, CT (US)

(73) Assignee: KB TLC BUYER, LLC, Atlanta, GA (US)

( * ) Notice: Subject to any disclaimer, the term of this patent is extended or adjusted under 35 U.S.C. 154(b) by 421 days.

(21) Appl. No.: 17/508,829

(22) Filed: Oct. 22, 2021

(65) Prior Publication Data

US 2022/0128241 A1 Apr. 28, 2022

Related U.S. Application Data

(60) Provisional application No. 63/104,877, filed on Oct. 23, 2020.

(51) Int. Cl.
*F24C 7/08* (2006.01)

(52) U.S. Cl.
CPC ..... *F24C 7/082* (2013.01)

(58) Field of Classification Search
CPC ..... F24C 7/082; F24C 7/086; F24C 3/124
USPC ..... 126/273 R, 19 R, 39 B
See application file for complete search history.

(56) References Cited

U.S. PATENT DOCUMENTS

2018/0187897 A1* 7/2018 Kim ..... F24C 7/086
2020/0408022 A1* 12/2020 Elder ..... E05F 15/54

* cited by examiner

*Primary Examiner* — Vivek K Shirsat
(74) *Attorney, Agent, or Firm* — Howard M. Gitten, Esq.; Lewis Brisbois Bisgaard & Smith LLP

(57) ABSTRACT

A drive structure for moving an articulated control panel on a cooking appliance includes a mounting bracket fixed in position relative to the cooking appliance. A frame is movably mounted to the mounting bracket. The frame includes a guide. A curved slot is formed within the guide; the curved slot engaging the mounting bracket to travel along the mounting bracket. A control panel is affixed to the frame to move therewith. A drive mechanism is rotatably affixed to the mounting bracket and attached to the control panel. The drive mechanism includes a shaft, the shaft moveable to extend from a first, withdrawn, position to a second, extended, position in a direction substantially parallel to the control panel causing the control panel to move relative to the mounting bracket.

11 Claims, 10 Drawing Sheets

DRIVE STRUCTURE FOR MOVING AN ARTICULATED CONTROL PANEL ON A COOKING APPLIANCE

CROSS REFERENCE TO RELATED APPLICATION

This application claims the benefit of U.S. Provisional Application No. 63/104,877 filed on Oct. 23, 2020, the entire disclosure of which is hereby incorporated in its entirety.

BACKGROUND OF THE INVENTION

The present invention relates to a control panel, and more particularly, to a structure for moving an articulated control panel relative to the cooking appliance upon which it is mounted.

Articulated, adjustable, control panels are known in the art. Articulated control panels rotate through an arc relative to the cooking appliance upon which it is mounted to facilitate reading and operation of the control panel. Movement is accomplished through spring assemblies, drive mechanisms, or both. However, as a result of the structure the conventional screw drive assemblies are complex in structure, too noisy, and because of the relatively small size of the motor to the driven object, the control panel, the motor is strained as it pushes and pulls the control panel between positions. Furthermore, the prior art motorized articulated control panels result in stress points along the structure resulting in fatigue and wear and tear. Lastly, the drive is provided in a confined space making the use of a normal drive impracticable.

Accordingly, there is a need for a drive system for an articulated control panel which overcomes the shortcomings of the prior art.

SUMMARY OF THE INVENTION

A drive structure for moving an articulated control panel on a cooking appliance includes a mounting bracket fixed in position relative to the cooking appliance. A frame is movably mounted to the mounting bracket. The frame includes a guide. A curved slot is formed within the guide; the curved slot engaging the mounting bracket to travel along the mounting bracket. A control panel is affixed to the frame to move therewith. A drive mechanism is rotatably affixed to the mounting bracket and attached to the control panel. The drive mechanism includes a shaft, the shaft moveable to extend from a first, withdrawn, position to a second, extended, position in a direction substantially parallel to the control panel causing the control panel to move relative to the mounting bracket away from the cooking appliance.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE PREFERRED EMBODIMENTS

Figure 1:
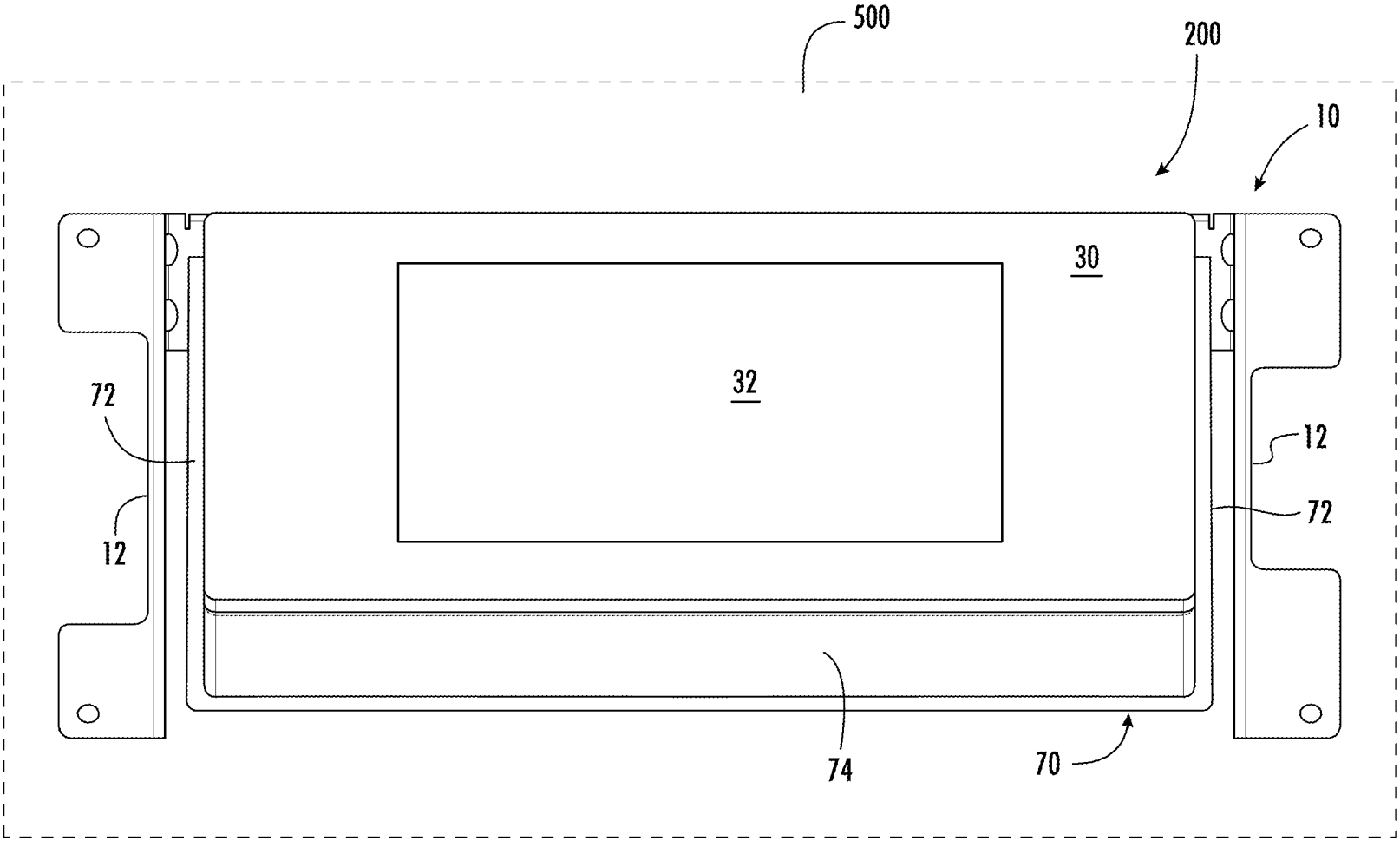
FIG. 1 is a front elevational view of a control panel assembly, in an extended position, and constructed in accordance with the invention.
Figure 2:
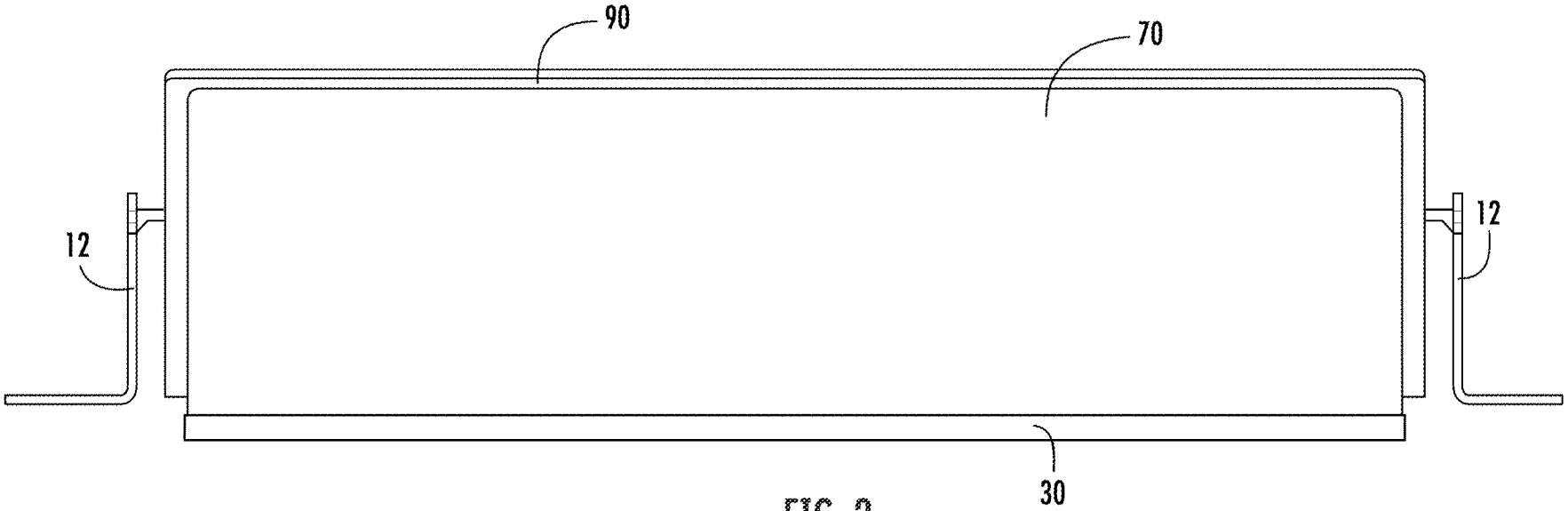
FIG. 2 is a bottom plan view of the control panel assembly, in a withdrawn position, constructed in accordance with the invention.

Reference is initially made to FIGS. 1 and 2 in which an articulated drive control panel assembly generally indicated as 200 is provided. Drive control panel assembly 200 includes a mounting bracket 10 affixed to a cooking appliance 500 (shown in phantom) at opposed mounting bracket sides 12 disposed on either side of mounting bracket 10.

Reference is now made to FIGS. 3, 5, 8 and 10 in which the structure of mounting bracket 10 is shown with greater particularity. Mounting bracket 10 has a substantially arch shape having a crossbeam 14 connected to first and second mounting bracket sides 12; each descending from opposed ends thereof. A top anchor 16 extends from crossbeam 14 in a direction away from a control panel 30. A pivot 17 is disposed within top anchor 16. A respective side anchor 18 extends from each mounting side bracket 12 in opposed facing relationship at substantially opposite ends thereof, and extends in a direction towards control panel 30.

Mounting bracket 10 is fixed in position to cooking appliance 500. As will be seen below, the remaining structure of control panel assembly 200 is either directly or indirectly movably affixed to mounting bracket 10.

Reference is now made to FIGS. 3, 4, 5 and 10 in which a frame 20, rotatably mounted to mounting bracket 10 is shown in detail. Frame 20 includes a perimeter 22 having an opening 24 therein. Each respective one of a pair of guides 26 extend from portions of perimeter 22 at opposed sides of opening 24, in a direction away from control panel 30. Slots 28 forming a curved path are formed in each of a respective one of guides 26.

Reference is now made to FIGS. 1, 4, 5 and 10 which show control panel 30 in detail. Control panel 30 has a front side and rear side. Front side of control panel 30 faces away from cooking appliance 500 and provides the interface for a user of cooking appliance 500. Control panel 30 includes operational controls which may take the form, in a preferred nonlimiting embodiment, of a graphical user interface (GUI) 32. However, it is well within the scope of the invention to provide mechanical pushbuttons, or a combination of LED, touch sensor, and mechanical controls.

Figure 3:
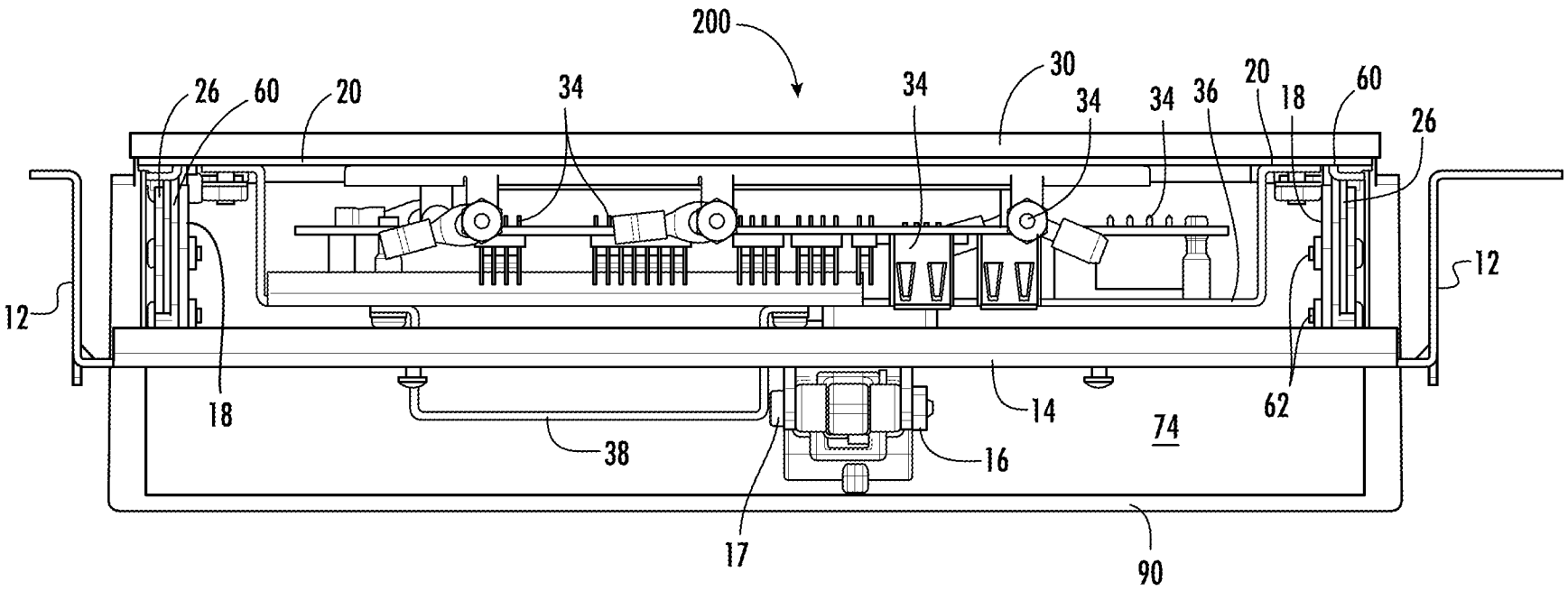
FIG. 3 is a top plan view of the control panel assembly constructed in accordance with the invention.
Figure 4:
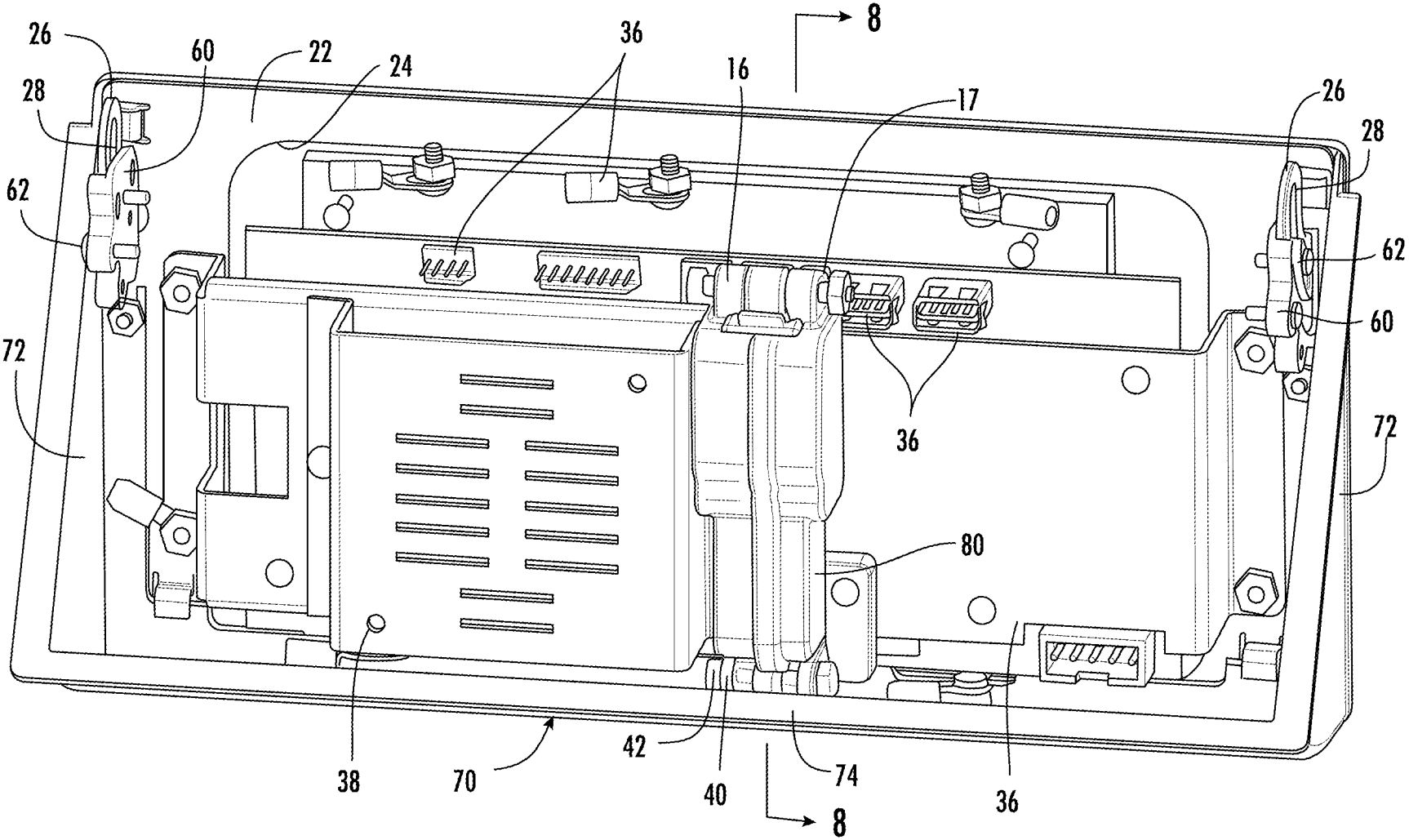
FIG. 4 is a rear perspective view of the control panel assembly, in a withdrawn position, in accordance with the invention.
Figure 5:
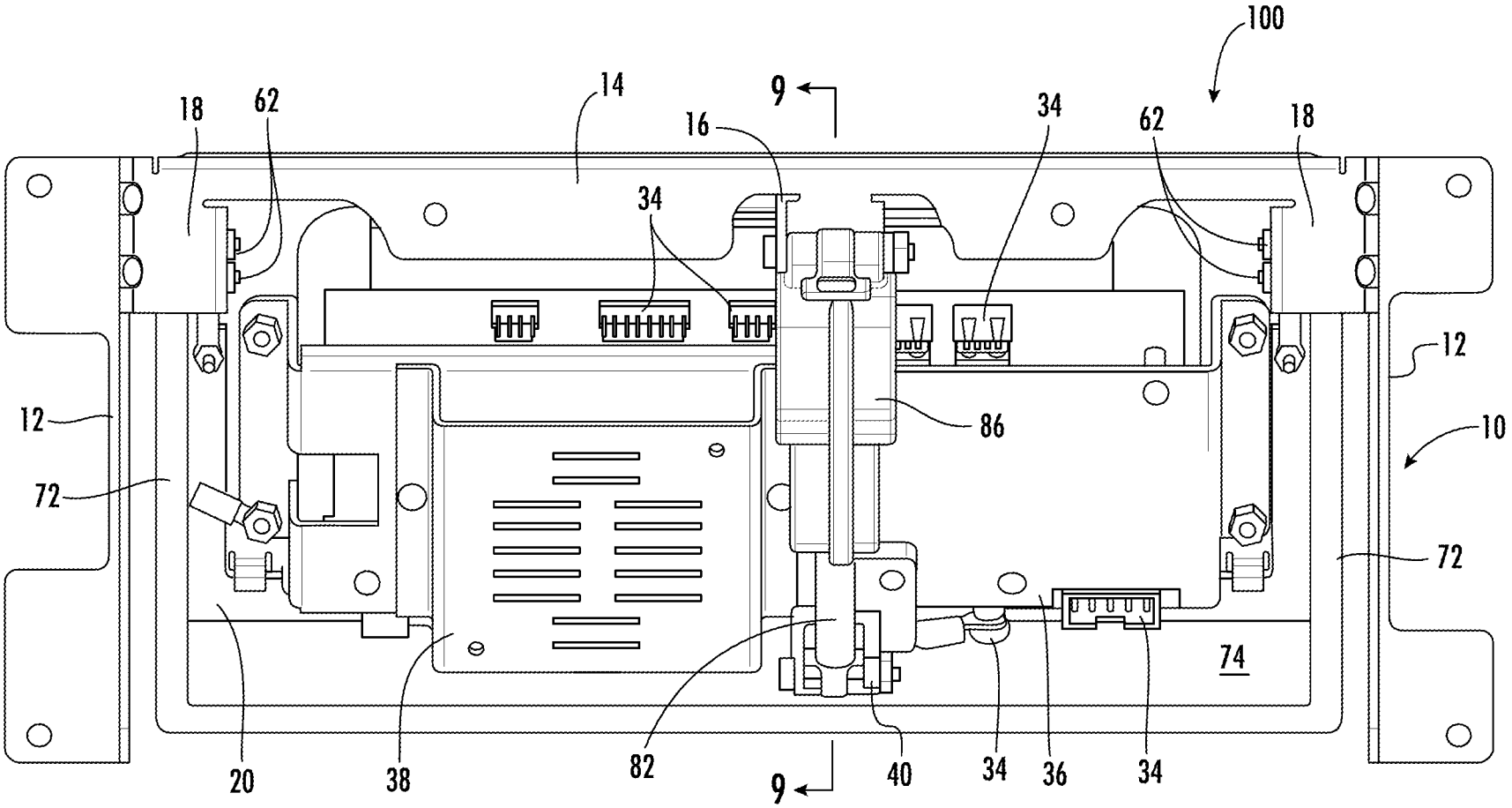
FIG. 5 is a rear perspective view of the control panel assembly, in an extended position, in accordance with the invention.

As seen more particularly in FIGS. 3, 4 and 5 the electromechanical operational structure of control panel 30 is disposed on the rear face of control panel 30 to protect the electromechanical structure. By way of nonlimiting example, the electromechanical structure may include electrical contacts 34 taking the form of wire leads and terminals, USB type contacts, and/or communication jacks. A guard plate 36 is affixed to the frame 20, such that much of the electromechanical structure is disposed between frame 20 and guard plate 36. A speaker cover 38 also extends from the rear face of control panel 30. A bottom anchor 40 is provided on the rear face of control panel 30. A pivot 42 is supported by bottom anchor 40.

As seen by way of example from FIG. 5 control panel 30 is affixed to the perimeter of frame 20 so that the electromechanical structure of control panel 30 extends through opening 24. In the preferred non-limiting embodiment, guard plate 36 may also be affixed to perimeter 22 of frame 20 sandwiching frame 20 between portions of control panel 30.

Reference is now made to FIGS. 3, 4, 6-8 and 10 in which a structure for a guide bracket 60 is shown. A respective guide bracket 60 is mounted on a respective opposed side anchor 18 of mounting bracket 10 utilizing projections such as screws 62 by way of non limiting example. As a result guide brackets 60 are fixed in position in opposed facing relationship to each other across mounting bracket 10. At least one screw 62 of a respective guide bracket 60 is received within a slot 28 of a respective guide 26 such that each guide bracket 60 engages slot 28 and an outer surface of guide 26. As a result guide 26 travels along screw 62, which is fixed in position, as frame 20 moves relative to mounting bracket 10. In effect guides 26, and in turn, frame 20, are moveably mounted to bracket 10.

Figure 9:
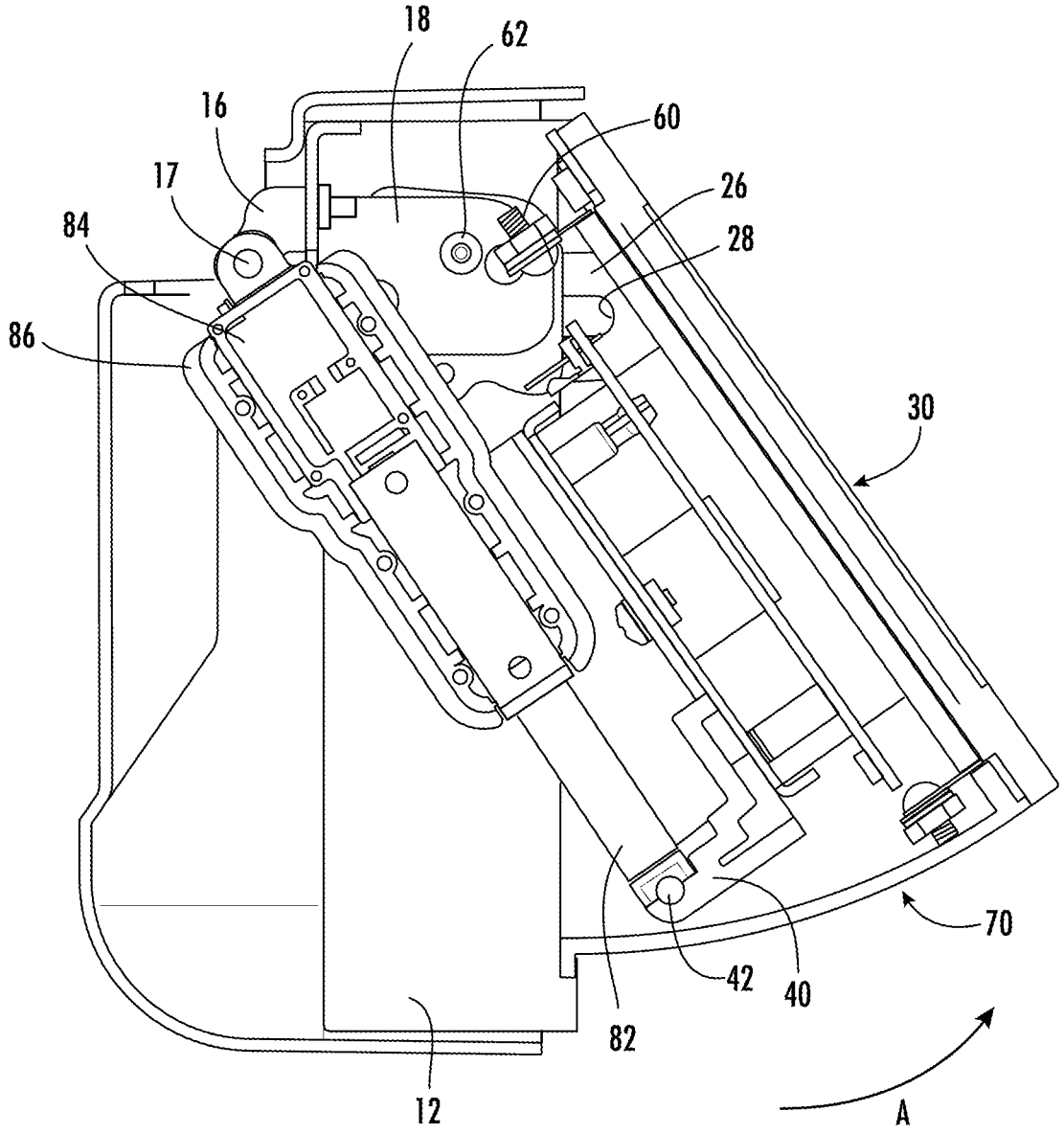
FIG. 9 is a sectional view taken through line 9-9 of FIG. 5.
Figure 10:
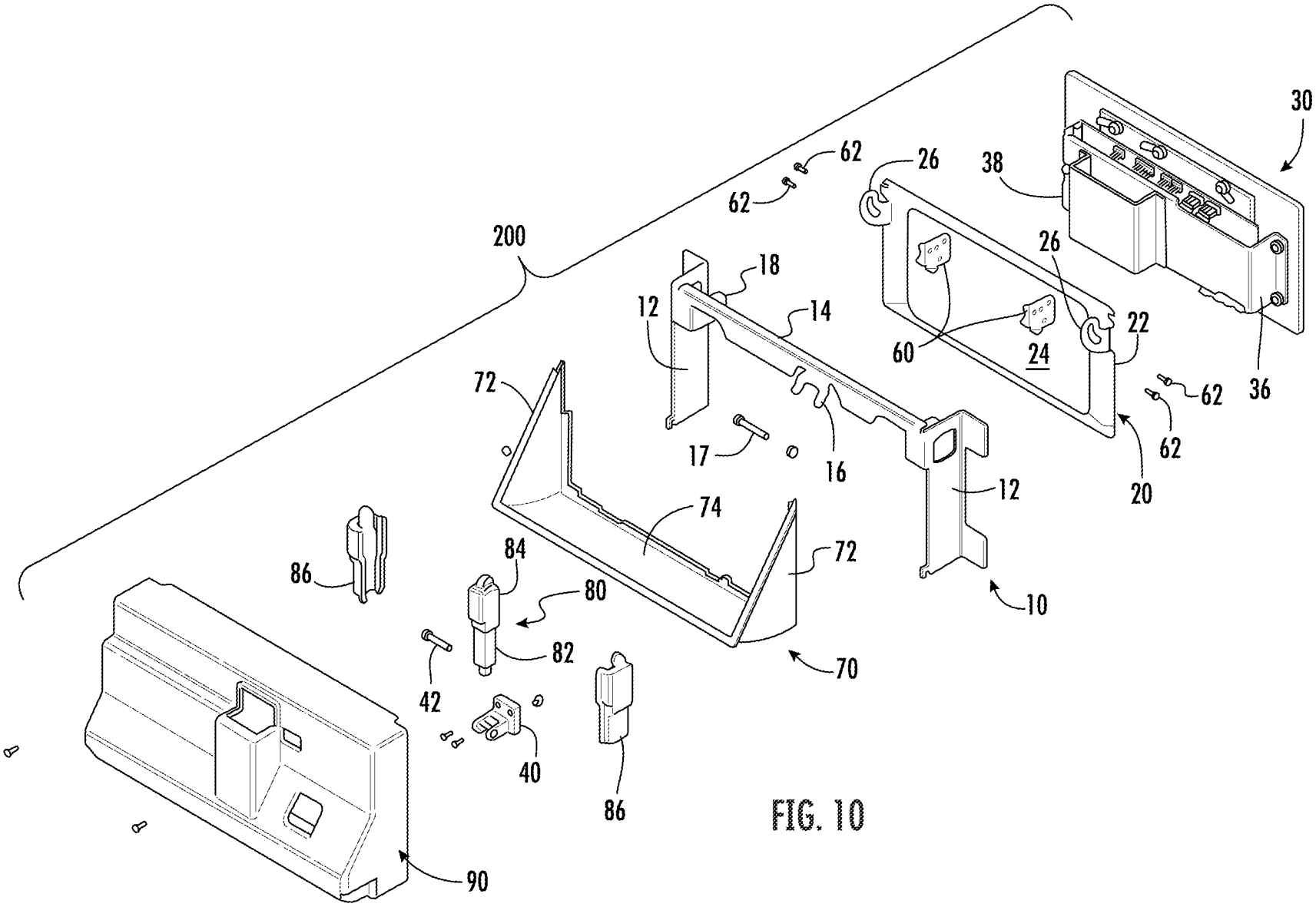
FIG. 10 is an exploded view of the control panel assembly constructed in accordance with the invention.

Reference is now made to FIGS. 1, 3, and 10 in which a shroud 70 is shown. Shroud 70 has opposed walls 72; each extending from an edge of a floor 74. Shroud 70 is affixed to frame 20 and moves with frame 20 as frame 20 rotates relative to mounting bracket 10 to provide protection by further hiding the electromechanical and other operating mechanisms interior relative to the cooking appliance 500 of control panel assembly 200. In a preferred nonlimiting embodiment, floor 74 is curved. As seen by way of example in FIG. 1 as control panel 30 rotates away from cooking appliance 500 (the position shown in FIG. 9) floor 74 of shroud 70 extends through mounting bracket 10, from cooking appliance 500, to provide protection to the interior of control panel assembly 200.

Reference is now made to FIGS. 3, 5, 9 and 10 in which a drive mechanism for rotating control panel 30 is shown. In a preferred nonlimiting embodiment, a drive mechanism 80 is a worm gear type drive mechanism, as known in the art, having a motor and circuitry, as known in the art, disposed in housing 84 for driving a shaft 82. The motor and circuitry contained in housing 84 and shaft 82 are further disposed within a casing 86. Shaft 82 is coupled to bottom anchor 40 by pivot 42. Casing 86, and in a preferred embodiment, a portion of housing 84 are coupled to top anchor 16 by pivot 17.

As can be seen, one end of drive mechanism 80 is secured to a fixed structure, top anchor 16 while a second end of drive mechanism 80 is a fixed to a movable structure, anchor 40. As a result, as shaft 82 extends from casing 86, drive mechanism 80 is caused to rotate about pivot 17, and as a result control panel 30, shroud 70, and frame 20 are caused to rotate in the direction of arrow A. See FIG. 9.

Figure 6:
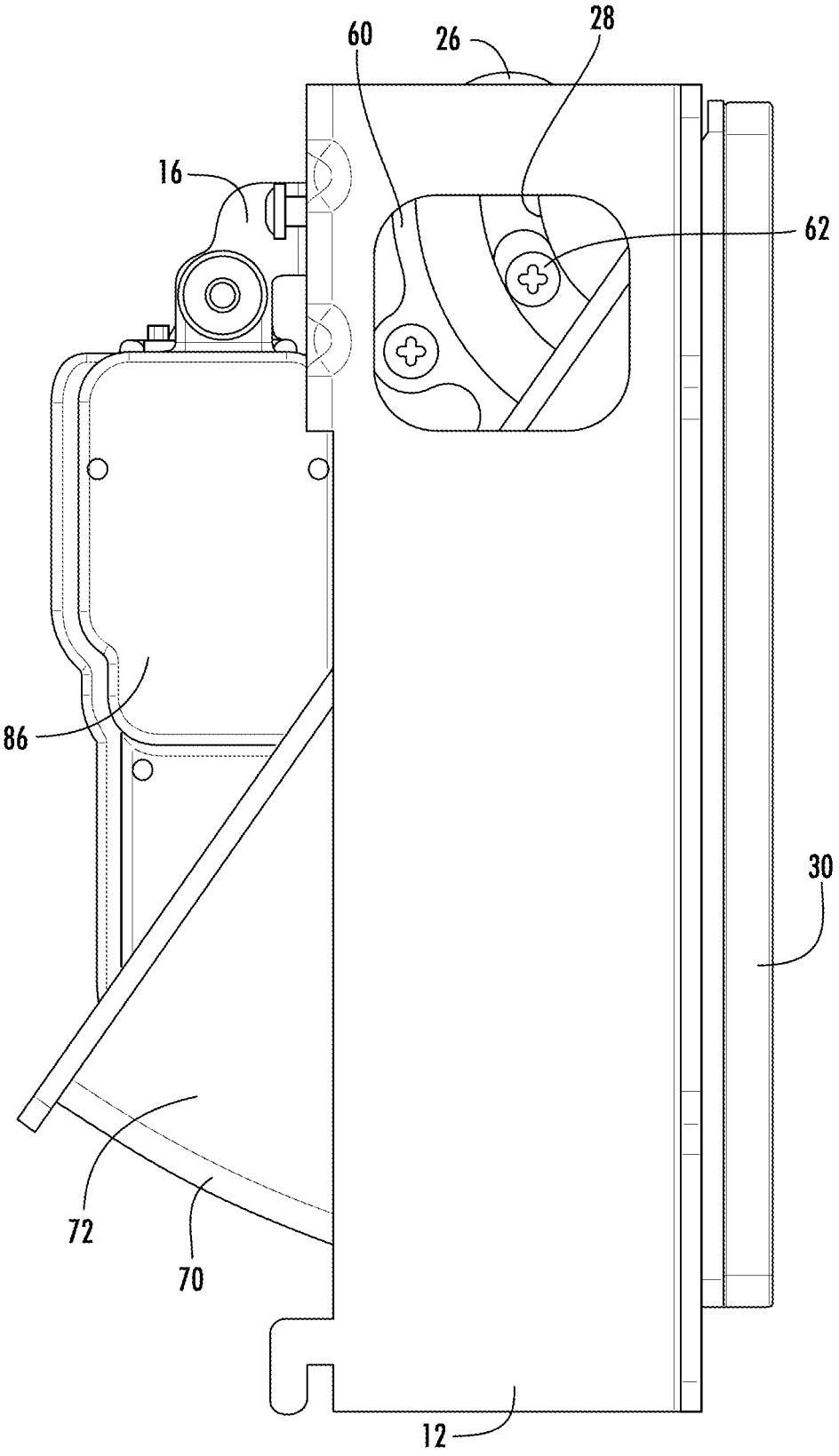
FIG. 6 is a side elevational view of the control assembly, in a withdrawn position, in accordance with the invention.
Figure 7:
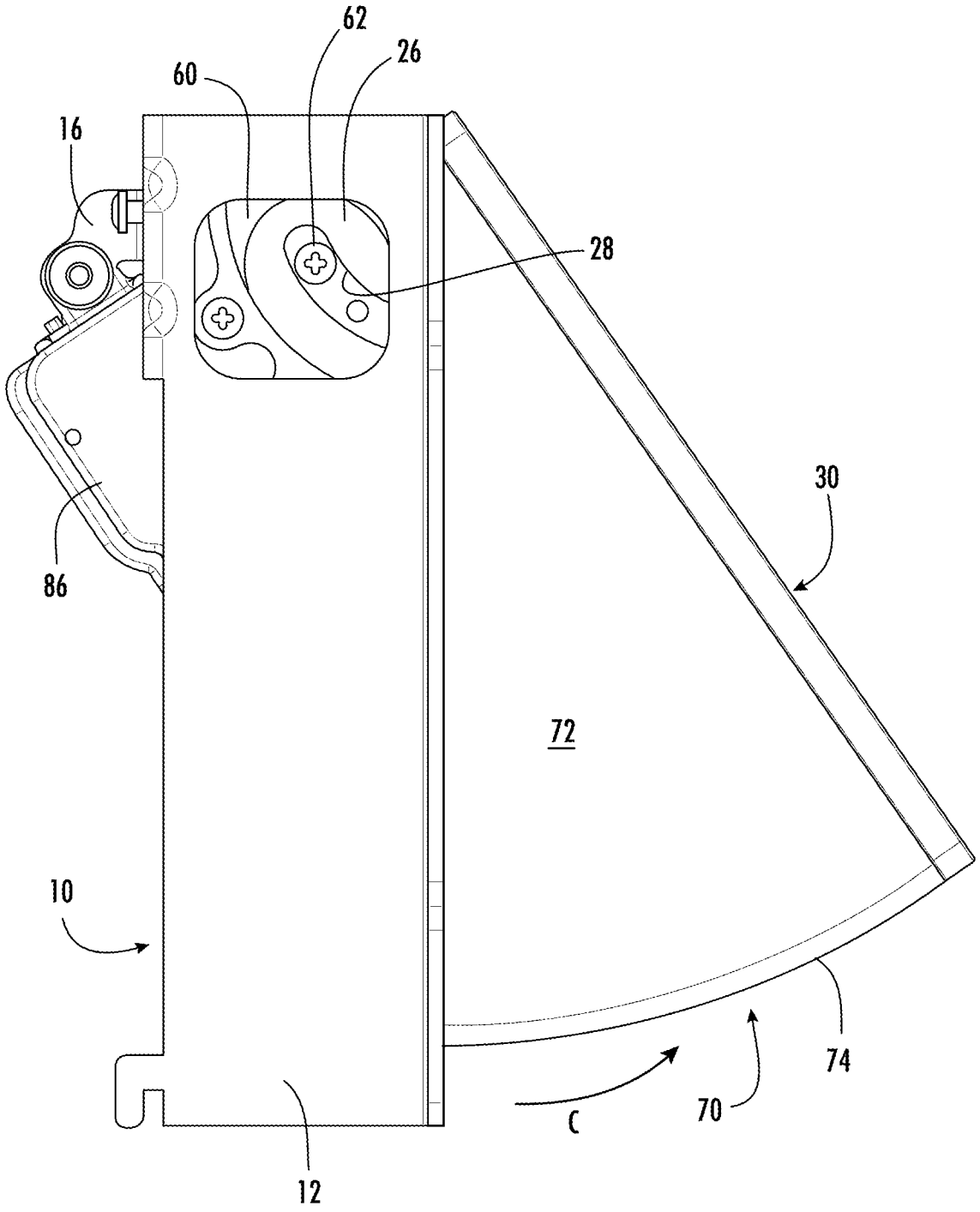
FIG. 7 is a side elevational view of the control panel assembly, in an extended position, in accordance with the invention.
Figure 8:
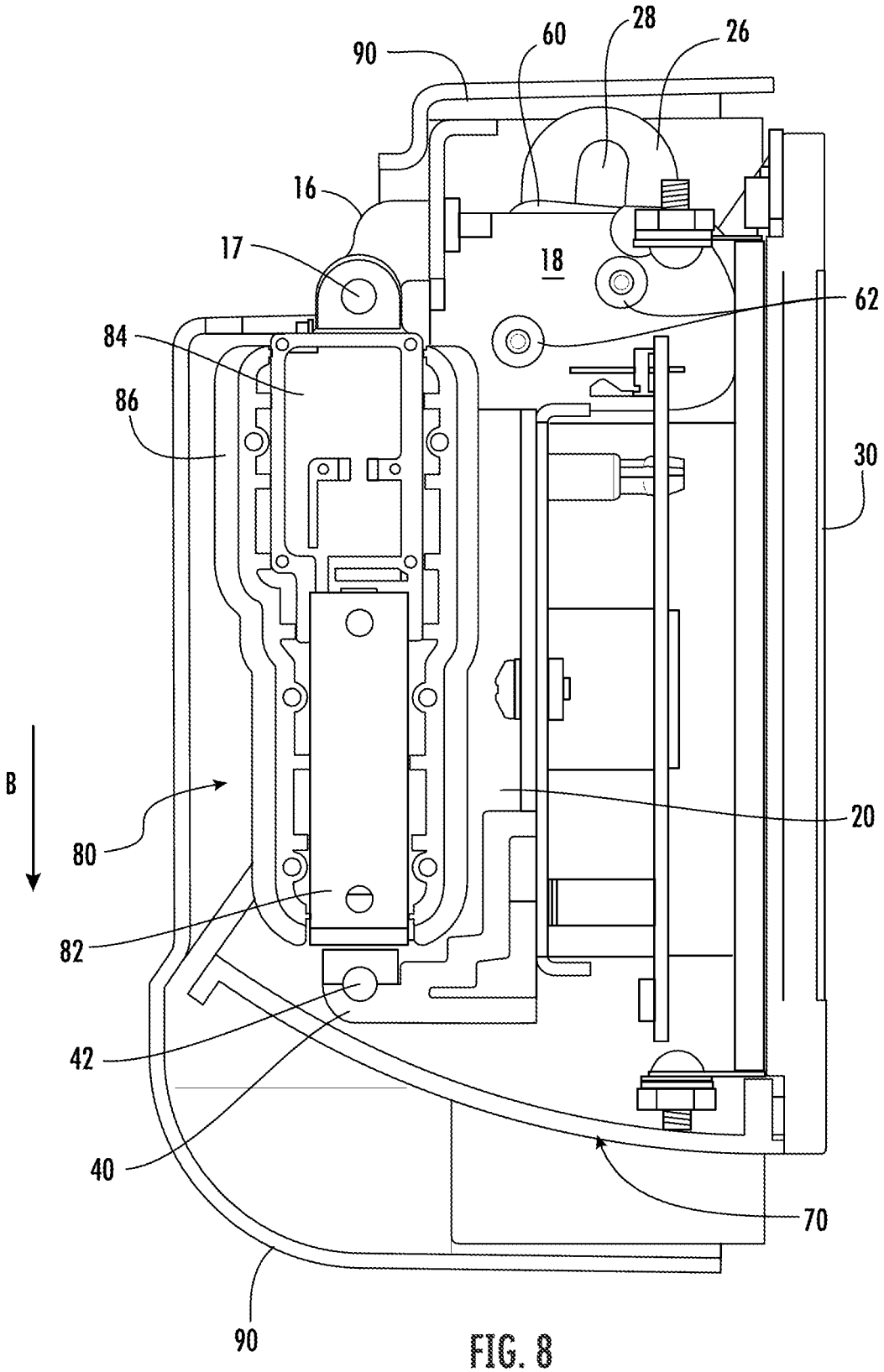
FIG. 8 is a sectional view taken through line 8-8 of FIG. 4.

More particularly, from a start position shown in FIG. 8 in which shaft 82 is in the contracted position; control panel 30 is relatively flush with cooking appliance 500. In this position, substantially all of control panel assembly 200 is located within a back cover 90. During operation, instructions to rotate control panel 30 for ease-of-use by a user, are received by the circuitry and motor control of drive mechanism 80 located within housing 84. If an instruction to tilt control panel 30 is received, drive mechanism 80 causes shaft 82 to extend. The force applied in the direction of arrow B (FIG. 8) is "downward". Frame 20 to which anchor 40 is affixed is in turn affixed to mounting bracket 10 and cannot move in the direction of arrow B. However, as seen in FIGS. 6 and 7, a force in the direction of arrow B will cause guides 26 to move along screws 62. The force of guides 26 on screws 62 rotates drive mechanism 80 about pivot 42; rotating drive mechanism 80. Because guides 26 are curved, they cause rotation of frame 20, and in turn rotation of shroud 70 and all of the structure affixed thereto in the direction of arrow C, tilting panel 30.

In this way a "downward" movement of shaft 82, from a withdrawn position to an extended position, in a direction substantially parallel to control panel 30, is translated into movement in a direction substantially orthogonal to the direction of movement of shaft 82. The substantially "downward" force applied by drive mechanism 80 is translated form downward motion and force to an orthogonal motion and force, as a result of the guides 28 taking the path of least resistance along screws 62, while also constraining movement in other directions. This allows use of a larger drive mechanism in a limited space. The use of the larger drive mechanism reduces strain on the drive structure and as a result reduces noise.

To withdraw control panel 30 into cooking appliance 500 as shown in FIGS. 2 and 6, and instructions sent to the control circuitry housed in housing 84 to drive the screwed drive in reverse causing movement of screws 62 in reverse direction along guides 25; withdrawing shaft 82 into casing 86. The instruction to tilt control panel 30 may be input directly into control panel 30, or be received from a remote location as known in the art.

It should further be recognized that the invention is not limited to the particular embodiments described above. Accordingly, numerous modifications can be made without departing from the spirit of the invention and scope of the claims appended hereto.

What is claimed is:

1. A drive structure for moving an articulated control panel on a cooking appliance comprising:

a mounting bracket fixed in position relative to the cooking appliance;

a frame rotatably mounted to the mounting bracket, the frame having a guide, a curved slot formed within the guide; the curved slot engaging the mounting bracket to travel along the mounting bracket;

a control panel affixed to the frame to move therewith; and a drive mechanism rotatably affixed to the mounting bracket and attached to the control panel, the drive mechanism having a shaft, the shaft moveable to extend from a first, withdrawn, position to a second, extended, position in a direction substantially parallel to the control panel causing the control panel to move relative to the mounting bracket away from the cooking appliance.

2. The drive structure of claim 1, wherein the drive mechanism is a worm gear.

3. The drive structure of claim 1, wherein the mounting bracket is affixed to the cooking appliance.

4. The drive structure of claim 1, wherein the drive mechanism moves the control panel between a first position relatively flush with cooking appliance and a second position not substantially flush with the cooking appliance as the drive mechanism extends between the first position and the second position.

5. The drive structure of claim 1, further comprising a pivot disposed on the mounting bracket, the driving mechanism being rotatable affixed to the mounting bracket at the pivot.

6. The drive structure of claim 1, wherein the frame has an opening, and further comprises a second guide disposed across said opening from said guide, a curved slot formed within the second guide; the curved slot of the second guide engaging the mounting bracket to travel along the mounting bracket.

7. The drive structure of claim 6, wherein the control panel is disposed within the opening of the frame.

8. The drive structure of claim 1, further comprising a second pivot disposed on the control panel, the drive mechanism being rotatably affixed to the control panel at the second pivot.

9. The drive structure of claim 5, further comprising a second pivot disposed on the control panel, the drive mechanism being rotatably affixed to the control panel at the second pivot.

10. The drive structure of claim 1, further comprising a guide bracket extending from the frame, the guide bracket having a projection extending therefrom, the guide receiving the projection to engage the mounting bracket.

11. The drive structure of claim 1, further comprising a shroud affixed to the frame, the shroud protecting a portion of the control panel therein.

* * * * *